US005400018A

United States Patent [19]

Scholl et al.

[11] Patent Number: 5,400,018

[45] Date of Patent: Mar. 21, 1995

[54] METHOD OF RELAYING INFORMATION RELATING TO THE STATUS OF A VEHICLE

[75] Inventors: Rolland D. Scholl, Dunlap; David R. Schricker; Satish M. Shetty, both of Peoria, all of Ill.

[73] Assignee: Caterpillar Inc., Peoria, Ill.

[21] Appl. No.: 995,461

[22] Filed: Dec. 22, 1992

[51] Int. Cl.[6] ..... G08B 26/00

[52] U.S. Cl. ..... 340/825.54; 340/825.52; 340/438; 364/424.03

[58] Field of Search ..... 340/827.06, 825.16, 340/825.54, 825.52, 539, 505, 438, 439, 870.07, 990; 364/424.03, 424.04

[56] References Cited

U.S. PATENT DOCUMENTS

| | | | |
|---|---|---|---|
| 4,258,421 | 3/1981 | Juhasz et al. | 364/424.04 |
| 4,367,458 | 1/1983 | Hackett | 340/531 |
| 4,897,642 | 1/1990 | DiLullo et al. | 340/825.06 |
| 5,058,044 | 10/1984 | Stewart et al. | 340/825.54 |
| 5,194,846 | 3/1993 | Lee et al. | 340/505 |
| 5,268,668 | 12/1993 | Berube | 340/505 |

*Primary Examiner*—James J. Groody
*Assistant Examiner*—Glenton B. Burgess
*Attorney, Agent, or Firm*—James R. Yee

[57] ABSTRACT

A method for reduces the amount of information relating to the status of a vehicle relayed from the vehicle to a remote location over a communications data link. The method includes the steps of generating a fault code, delivering the fault code to the remote location across the data link, and receiving the fault code at the remote location and responsively generating a data request signal. The data request signal is delivered to the vehicle over the data link, and vehicle information is generated and delivered to the remote location over the data link.

10 Claims, 9 Drawing Sheets

METHOD OF RELAYING INFORMATION RELATING TO THE STATUS OF A VEHICLE

TECHNICAL FIELD

This invention relates generally to a method for relaying information from a vehicle at a work site to a remote location and, more particularly, to a method for reducing the amount of information being relayed.

BACKGROUND ART

Emerging technologies have enabled remote work locations to become safer, more efficient and more automated. For example, increased diagnostic capabilities have allowed work vehicles at a work site to perform on-board diagnostics to reduce downtime by preventing certain kinds of breakdowns. These systems allow for preventative maintenance.

These diagnostic systems and advanced sensor arrays produce a tremendous amount of information. This information allows the operating level of the vehicle, that is, its performance, efficiency, and other operating characteristics to be known at all times.

Some of this information may be used on board the vehicle to perform low level diagnostics. However, due to on-board computing power limitations and the lack of operator expertise in using this information to diagnose the vehicle and its systems, the information is more useful off-board the vehicle. Off-board this information may be used to perform diagnostics, prognostics (the ability to prevent a breakdown before it occurs), and also to develop new diagnostics and prognostics.

There are a number of ways in which information may be relayed from a vehicle to a location where it can be used fully. For example, the vehicle could be equipped with a control module which includes a storage medium such as a battery backed static ROM. An external computer, such as a portable or laptop computer, may be connected to a data link on the vehicle and information downloaded to the external computer.

Another way that information may be transferred from the vehicle to the remote location is through a communications, for example, satellite, radio, or other radio frequency means. A number of telecommunications companies provide a service of transferring data from one location to another through the use of a telecommunications satellite. This provides increased flexibility since the vehicle does not have to be at a certain location for information to be transferred. Furthermore, this method also saves time since a technician does not have to download the information physically. Also, the transfer can be practically instantaneous. This allows for faster response to problems which have developed or are about to develop.

However, these communication services are expensive. This only becomes more apparent when it is recognized how much information is produced by the vehicle's systems. Therefore, it is desirable to reduce the amount of information that is required to be transferred while providing relevant information when needed.

The present invention is directed at solving one or more of the problems as set forth above.

DISCLOSURE OF THE INVENTION

In one aspect of the present invention a method for reducing the amount of information relating to the status of a vehicle being relayed to a remote location over a communications data link is provided. The method includes the steps of generating a fault code, delivering the fault code to the remote location across the data link, receiving the fault code at the remote location and responsively generating a data request signal. The method further includes the steps of delivering the data request signal to the vehicle over the data link (212), receiving the data request signal, responsibly generating vehicle information, and delivering the generated vehicle information to the remote location over the data link.

BEST MODE FOR CARRYING OUT THE INVENTION

The present invention provides a method for relaying needed information between a vehicle and a remote location. The present invention has many applications. For explanation purposes only, the present invention will be discussed in relation to two applications.

Figure 1:
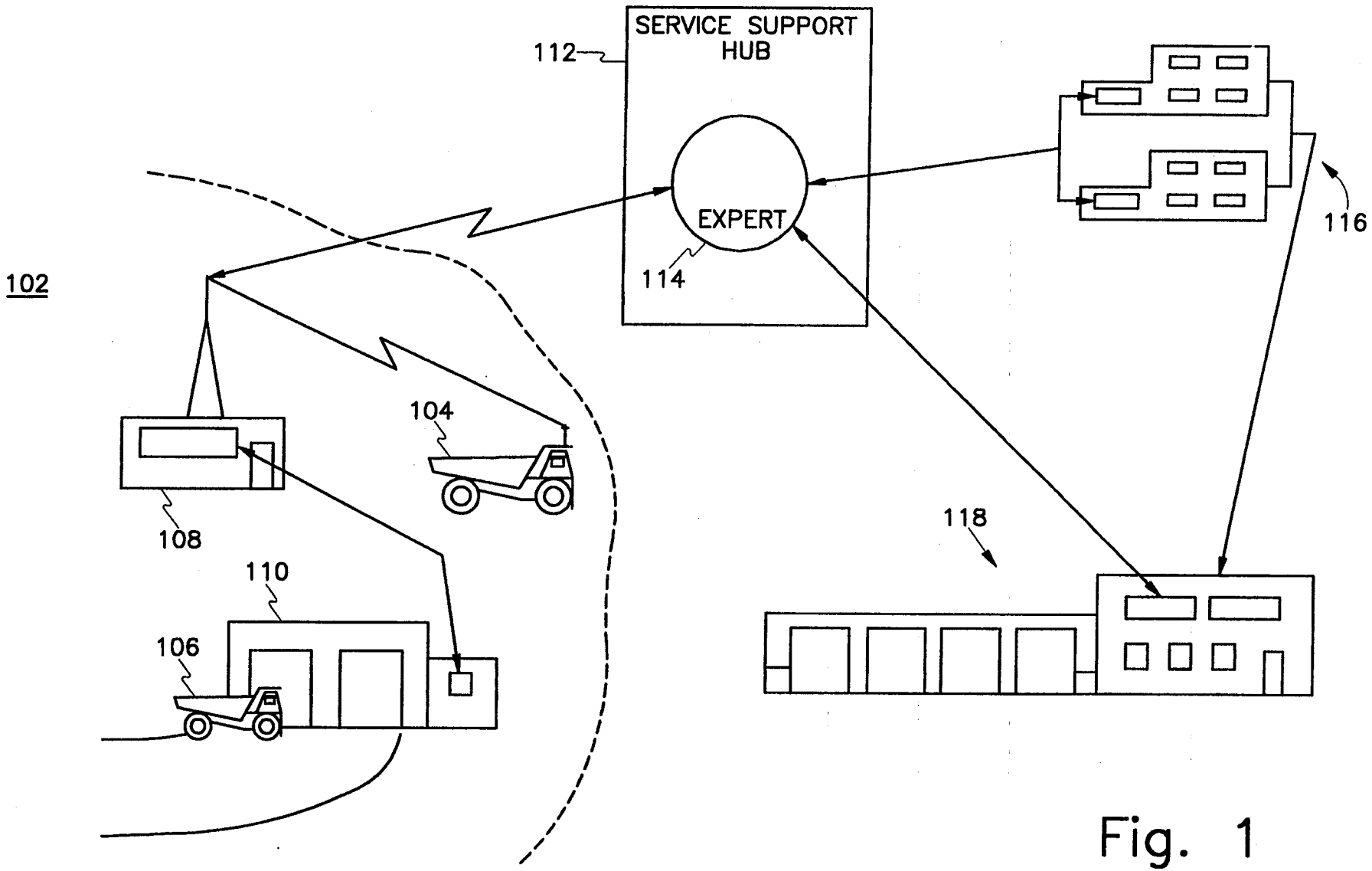
FIG. 1 is a diagrammatic representation of a work site with three trucks, a service support hub and service centers.

With reference to FIG. 1, the present invention may be adapted to relay information from a fleet of vehicle situated at a work site 102, for example a mine site. For simplicity, two hauling vehicles 104,106 are shown, but a mine site will typically utilize a larger number and variety of vehicles. All of which may generate information utilized by the present invention.

At the mine site 102 are located a dispatcher 108 and a service center 110. The dispatcher 108 coordinates the operation of the mine site including scheduling of the work vehicle's operation and scheduling vehicle maintenance. The service center 110 performs routine maintenance and repairs.

The vehicles 104,106 generate a set of data relating to its operation. The data is relayed according to the method of the present invention to a service support hub 112. At the service support hub 112 an expert 114 reviews the data from the vehicle 104,106. After analysis, the expert 114 may issue a set of repair instructions. The repair instructions are relayed to the service center 110 at the mine site 102 and/or to a dealer service center 118. Depending upon the needed repairs, the maintenance may be done at the service center or the dealer service center 118. In either case, the repair orders to the dealer service center 110 may include a list of needed parts.

It is envisioned that the expert 114 at the service support hub 112 may be an employee of the dealer, the mine operator, or the manufacturer of the vehicle 104,106.

In addition, the date received from the trucks 104,106 may be relayed to vehicle specialists at another remote location 116. At this location, the data may undergo further analysis to detect and identify current and potential problems. The data may also be used to develop future diagnostics and prognostics.

Figure 2:
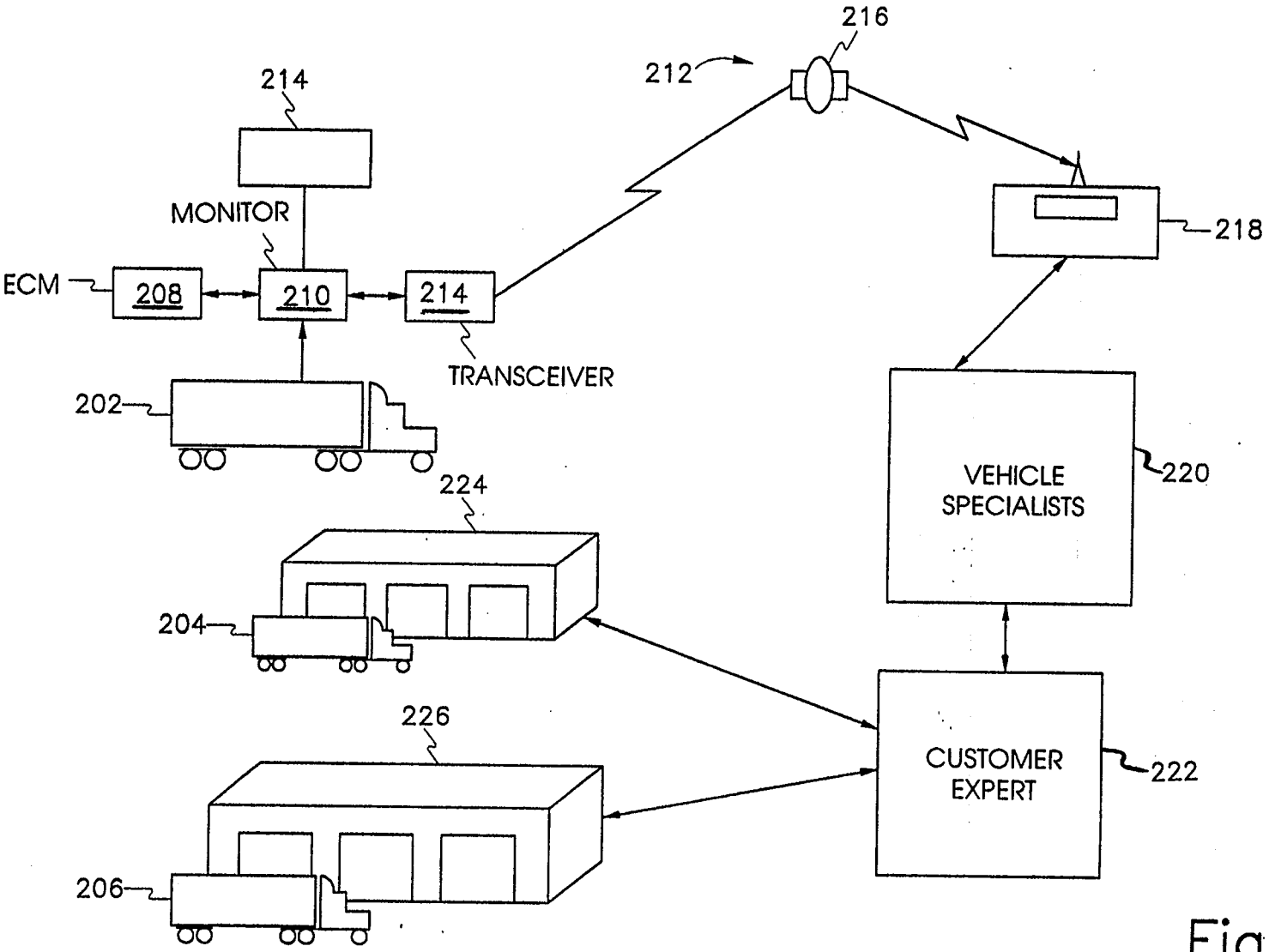
FIG. 2 is a diagrammatic representation of a fleet of trucks each having a monitor, a remote service site, and a satellite communications network for relaying information between the two.

With reference to FIG. 2, the method of the present invention may be adapted to a fleet of highway transportation trucks. As shown, the fleet of three trucks 202,204,206 are not confined to a small work site, but operate over a larger less-defined area.

Each truck 202,204,206 includes a monitor 210. In the preferred embodiment, the monitor 210 is microprocessor based. The monitor 210 receives data from a plurality of sources on the vehicles. The types of sources include sensors and electronic control modules (ECM). Typically electronic control modules are used to control one subsystem of the vehicle, for example, the vehicle's engine or transmission. The ECM uses sensor information and may also generate its own set of parameters. The ECM may transfer the sensor information it receives and some of the parameters it generates internally to the monitor 210.

Data is relayed to outside locations using a satellite communications network 212, The network 212 includes at least one satellite 216. In the preferred embodiment, satellite communications are purchased as a service. One suitable service is provided by Qualcomm, Inc., having offices at 10555 Sorrento Valley Rd. San Diego, Calif. 92121. Qualcomm also provides a suitable terminal as the OmniTRACS Mobile Communications Terminal (MCT).

A transceiver 214 provides communications between the monitor 210 and the satellite communications network 212. A satellite base 218 receives the data from the satellite 216 and relays the data to the customer. As shown, the data is used by vehicle specialists 220 and experts 222 to generate repair instructions. The repair instructions are relayed back to the vehicle 202,204,206 and to a service center 224 and/or dealer service center 226.

Figure 3:
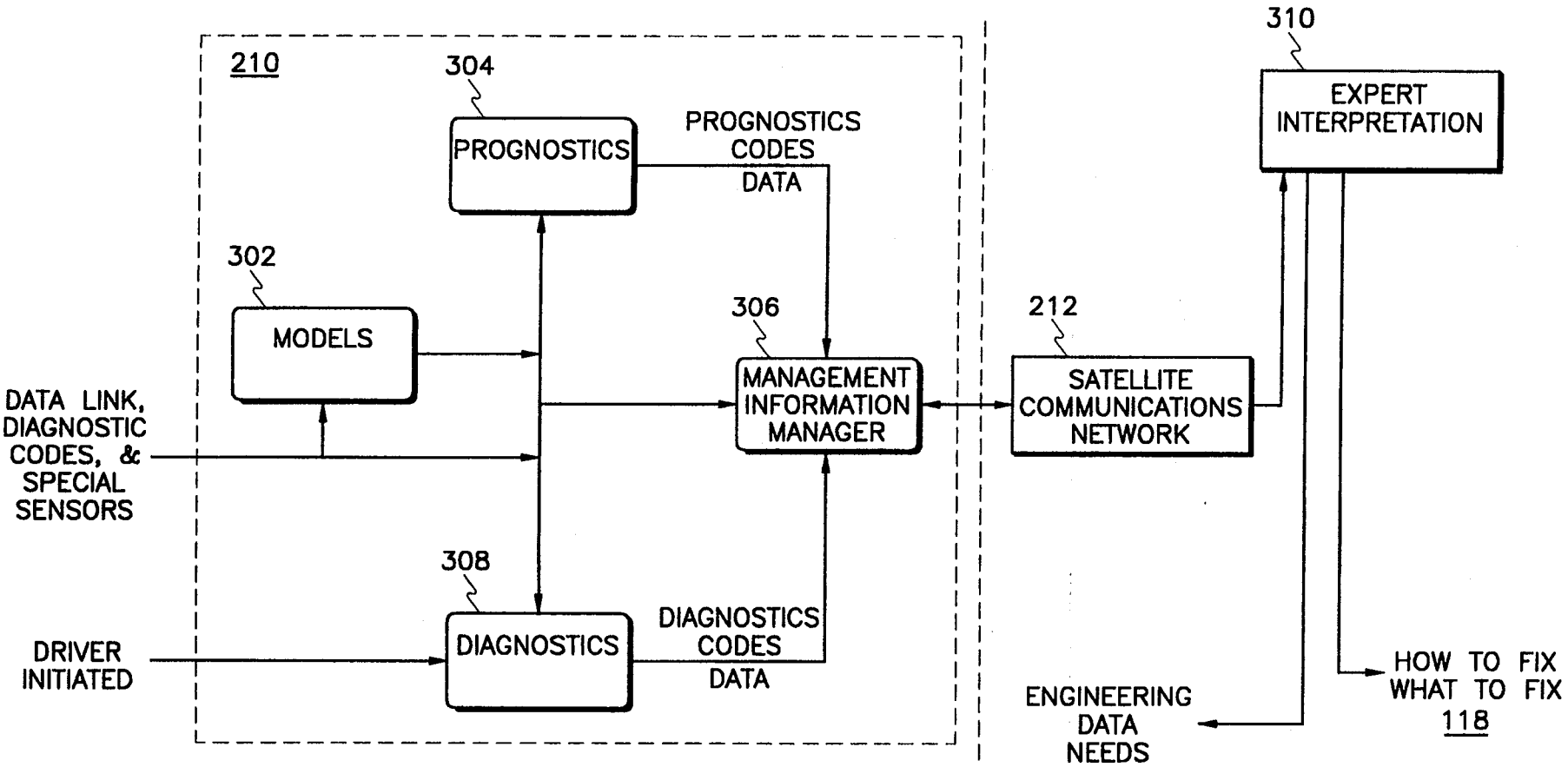
FIG. 3 is a block diagram illustrating the monitor of FIG. 2.

With reference to FIG. 3, each vehicle 104,106 may include a variety of sensors, diagnostics 308, and/or prognostics 304. In addition, the vehicle 210 may include one or more computer based models 302.

In one embodiment, the diagnostics, prognostics, and/or models are implemented on the monitor 210.

In an other embodiment, the diagnostics, prognostics may be implemented by an ECM 208. The ECM 208 may be a dedicated ECM or may be shared with another function.

A management information manager (MIM) gathers and otherwise prepares the data from each of the sources for transmission.

The models use sensor data to model or predict the value of a specific vehicle parameter or parameters. The same parameter or parameters are measured. The measure and modeled values are compared. The difference may be used in the diagnostics and/or prognostics. One such model is disclosed in International Application No. PCT/US91/09322, filed by William L. Brown, Jr., et al. on Dec. 19, 1991.

The sensors and models generate a set of data every at. In the preferred embodiment, data is generated every second. This information is stored on a storage device on the vehicle 202,204,206.

The monitor 210 produces a fault code in response to predetermined conditions in the diagnostics, the prognostics, or in response to an operator generated signal.

The diagnostics 308 compare measured or actual values of parameters to preset operating ranges. The ranges may vary depending upon other operating conditions. The diagnostics produce a fault code in response to a parameter value operating outside of its preset range. The diagnostics may produce a predetermined number of fault codes. Each fault code is an indication of a particular fault, that is, a particular parameter operating outside its preset range.

The prognostics 304 analyze data in order to detect conditions that may lead to future problems. For example, a specific parameter may be operating in its preset range, but may be decreasing at an unusual rate. The unusualness of the decrease may be an indication of a fault condition about to happen. Therefore, the prognostics 304 may be adapted to look at the rate change of specific parameters and responsively generate fault codes.

The other type of fault code is the driver initiated code. This code is generated in response to the vehicle operator actuating a switch. In one embodiment, the monitor 210 is equipped with a single switch. In an other embodiment, the monitor 210 is equipped with a plurality of switches. The operator actuates a switch after experiencing unusual operating conditions. In the other embodiment, each switch may be linked to a specific type of or area of problem. This would give the expert 114 additional information to use in the decision for more data.

Figure 7:
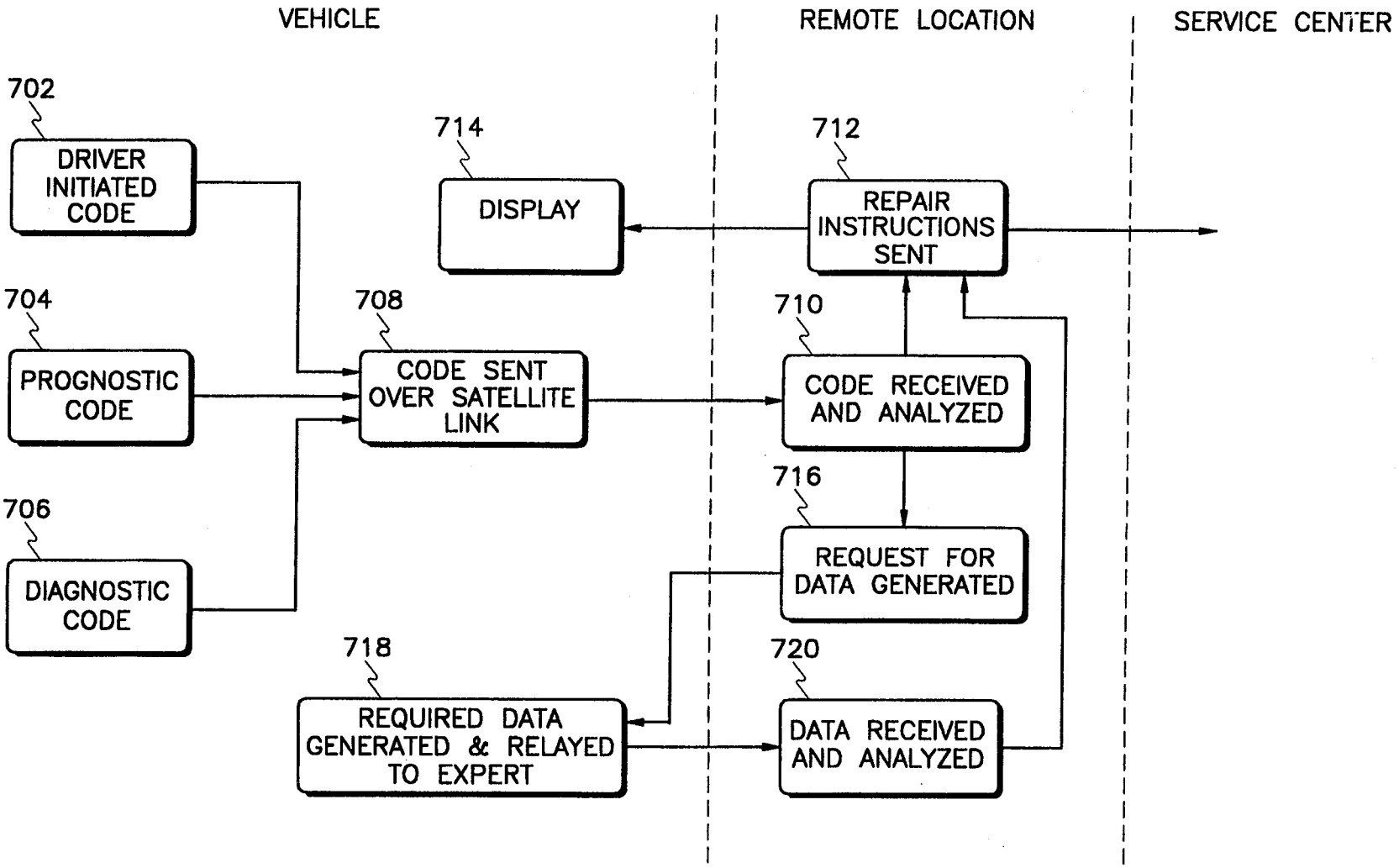
FIG. 7 is a block diagram of a method for relaying information between a truck and a remote location, according to an embodiment of the present invention.

With reference to FIG. 7, the present invention provides a method for cutting the costs associated with the use of a satellite communication network 212. The monitor 210 generate a fault code based on the diagnostics, prognostics or in response to an operator generated signal in function blocks 702,704 or 706. The fault code is transmitted across the satellite communications network 212 to an expert at one of the remote locations in functional block 708.

The code is received and analyzed by the expert 310 in functional block 710. The expert 310 has a history of the vehicle, for example, its maintenance records, past fault codes, and other data previously transmitted from the vehicle. In analyzing the fault code in view of this record, the expert 114 may decide that (1) certain repairs are needed, or (2) additional information is needed.

If the expert 114 decides that additional information is needed then a data request signal is produced (function block 716). The data request signal is transmitted back to the monitor 210 on the vehicle through the satellite communications network 212. The data request signal describes the information needed and in what form (see below).

In response to the data request signal, the monitor 210 retrieves the requested information from storage and transmits it back to the expert (function block 718). Based on this data, the expert can make repair recommendations (function blocks 720,712).

The expert 114, after receiving the fault code, may in view of the vehicle's history have enough information to generate repair instructions.

As discussed above, the monitor 210, gathers information from a number of sources (sensors and models) and stores the data in a storage medium. Preferably each of the parameters included in the information is gathered at 1.0 second increments. The list of parameters gathered by the monitor 210 include, but is not limited to:

| | |
|---|---|
| Date | Time |
| Engine Speed | Vehicle Speed |
| Fuel Rate | Oil Pressure Rail |
| Oil Pressure Pump | Oil Pressure Pump-Rail |
| Boost Pressure | Rack |
| Des Engine Timing | Coolant Temperature |
| Atmospheric Pressure | Inlet Air Pressure |
| Air Filter D/P | Intake Manifold Pressure |
| Intake Manifold Temperature | Inlet Air Temperature |
| Fuel Temperature | Brake temperature |
| Exhaust Temperature | |
| Computer-based Model Parameters | |

The above list is exemplary only and is not intended to be a complete list of all possibilities. The exact list will be dependent upon, the specific vehicle, the sensors available on the vehicle, and the computer-based models.

As stated above, the data request signal is indicative of the type of data required. Furthermore, depending upon the surrounding circumstances, the data may be requested in one of a plurality of forms. In the preferred embodiment, the data may be transmitted back to the expert 114 in a "snap-shot" form or in a "trend" form.

Data in snap-shot form refers to the data as captured or stored. Therefore, in the preferred embodiment, this means in 1.0 second increments. Preferably, the data sent will be from a predetermined period of time before the fault code is generated and a predetermined period of time after the fault code is generated. Typically a snap-shot of data is over a short range of time, typically less than 500 seconds worth of data. In the preferred embodiment, a snap-shot of data includes data from five minutes (300 seconds) before to one minute (60 seconds) after the fault code occurred. However, a snapshot gives an excellent indication of the operating conditions at the time of the fault code.

Figure 5:
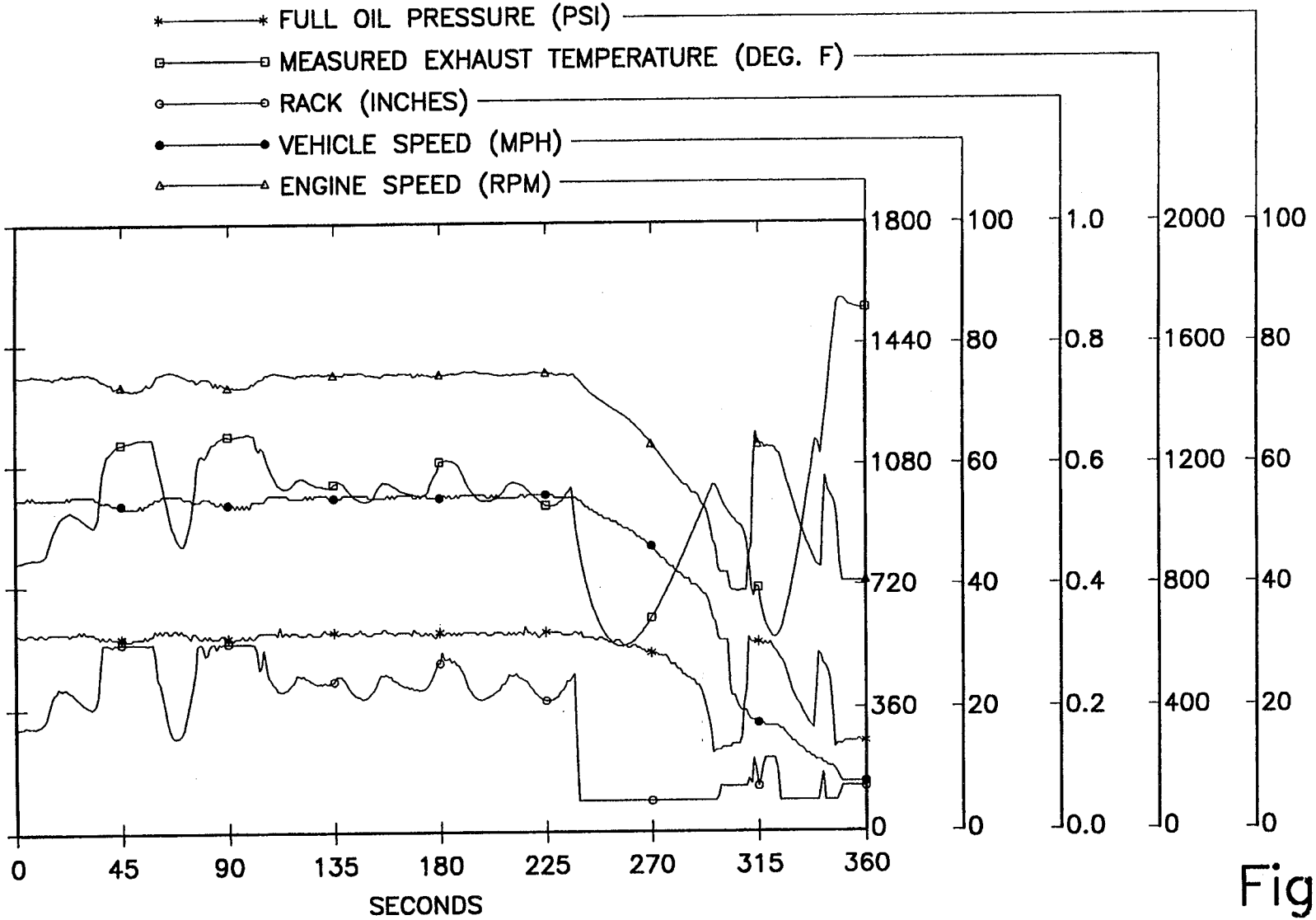
FIG. 5 is a graphical representation of a "snapshot" of a set of truck parameters.
Figure 6:
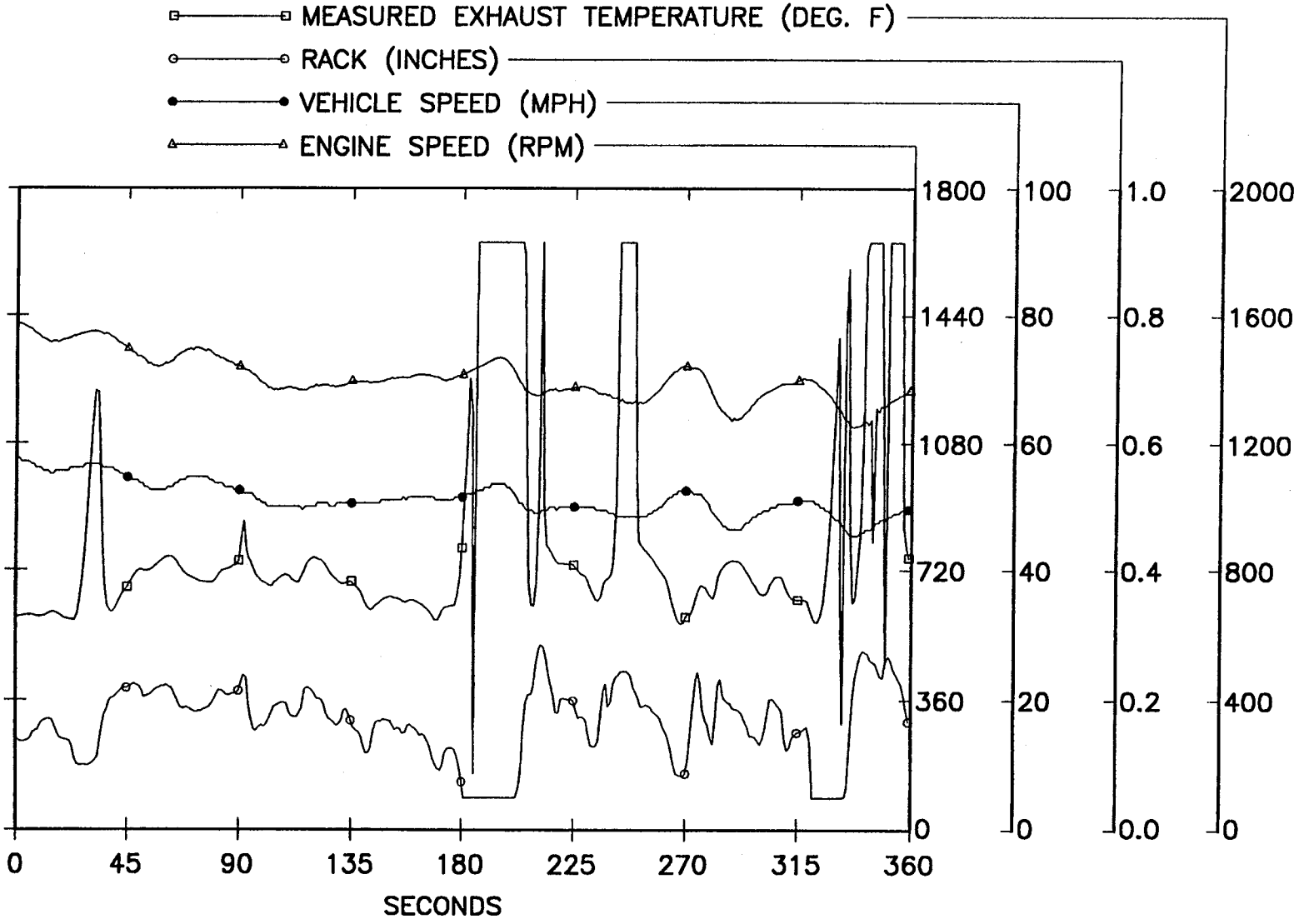
FIG. 6 is a graphical representation of a "snapshot" of another set of truck parameters.

Examples of data in snapshot form is shown in FIGS. 5 and 6. In FIG. 5 the snapshot includes data of five parameters: oil pressure, exhaust temperature, rack, vehicle speed, and engine speed. The data in FIG. 5 was taken in response to an oil pressure fault code. The fault code occurred at the 300 second mark. The snapshot includes data from five minutes prior to 1 minute after the fault code.

In FIG. 6 the snapshot includes data of four parameters: exhaust temperature, rack, vehicle speed, and engine speed. The data in FIG. 6 was taken in response to an operator initiated fault code. As in FIG. 5, the fault code occurred at the 300 second mark. And the snapshot includes data from five minutes prior to 1 minute after the fault code.

Figure 4:
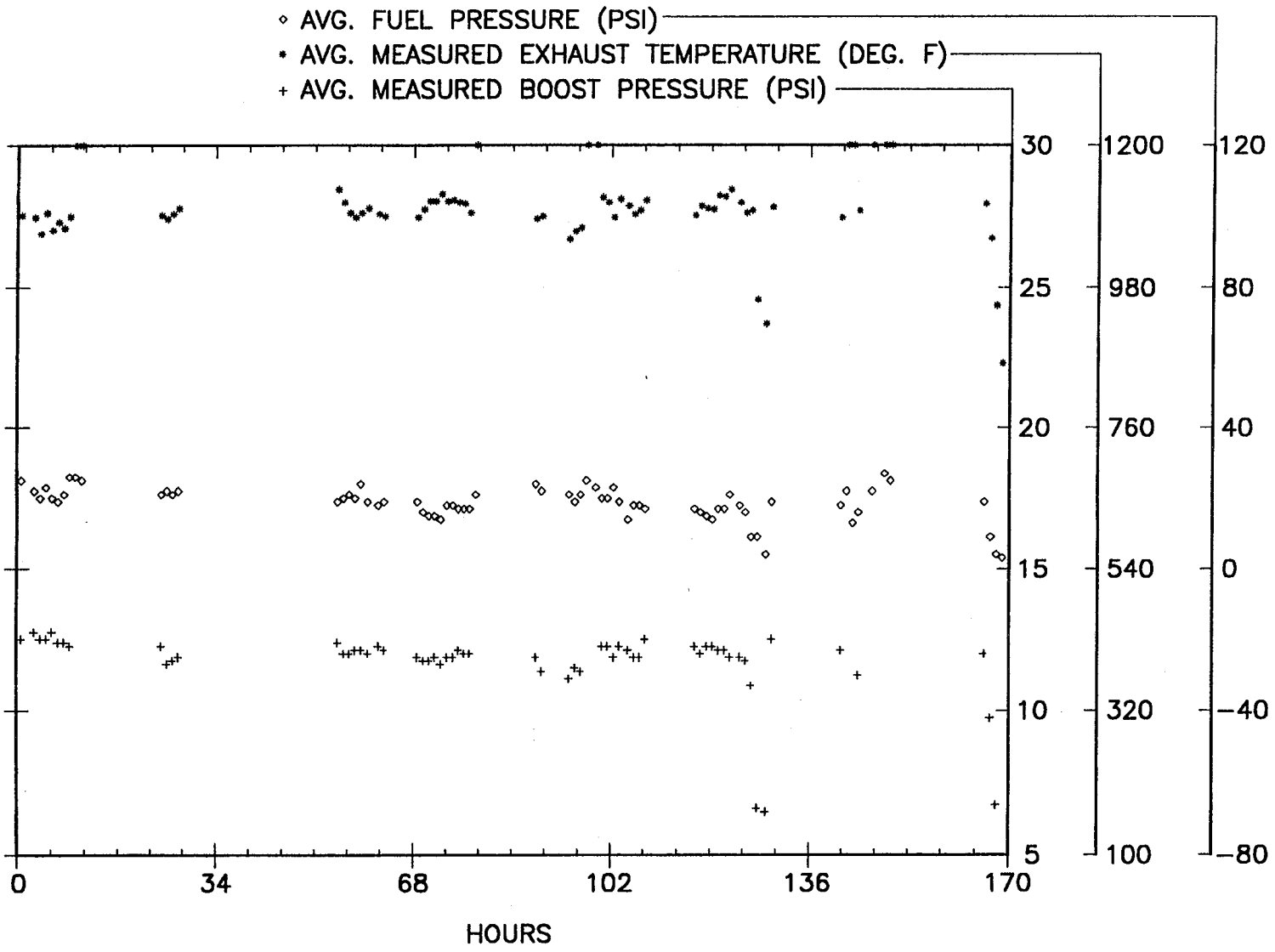
FIG. 4 is a graphical representation of information related to the operation of a truck averaged over one engine hour of operation.

Trend data is shown in FIG. 4. The data shown is averaged over a specified period of time. In the preferred embodiment, data is averaged over one hour time periods. The data shown in FIG. 4 represents only one possible set of data transmitted: average fuel pressure, average exhaust temperature, and average boost pressure. The data in FIG. 4 was taken in response to a low power fault code. However, an analysis of the data indicates a downward trend in the measured parameters prior to the fault code. The parameters were not outside the respective preset ranges, therefore no diagnostic fault code was generated. However, it is believed that recognition of the rate of change of specific parameters gives an indication of future problems which can be avoided, prevented, or at least minimized. The recognition of these conditions would prompt the generation of prognostic fault codes.

Figure 8:
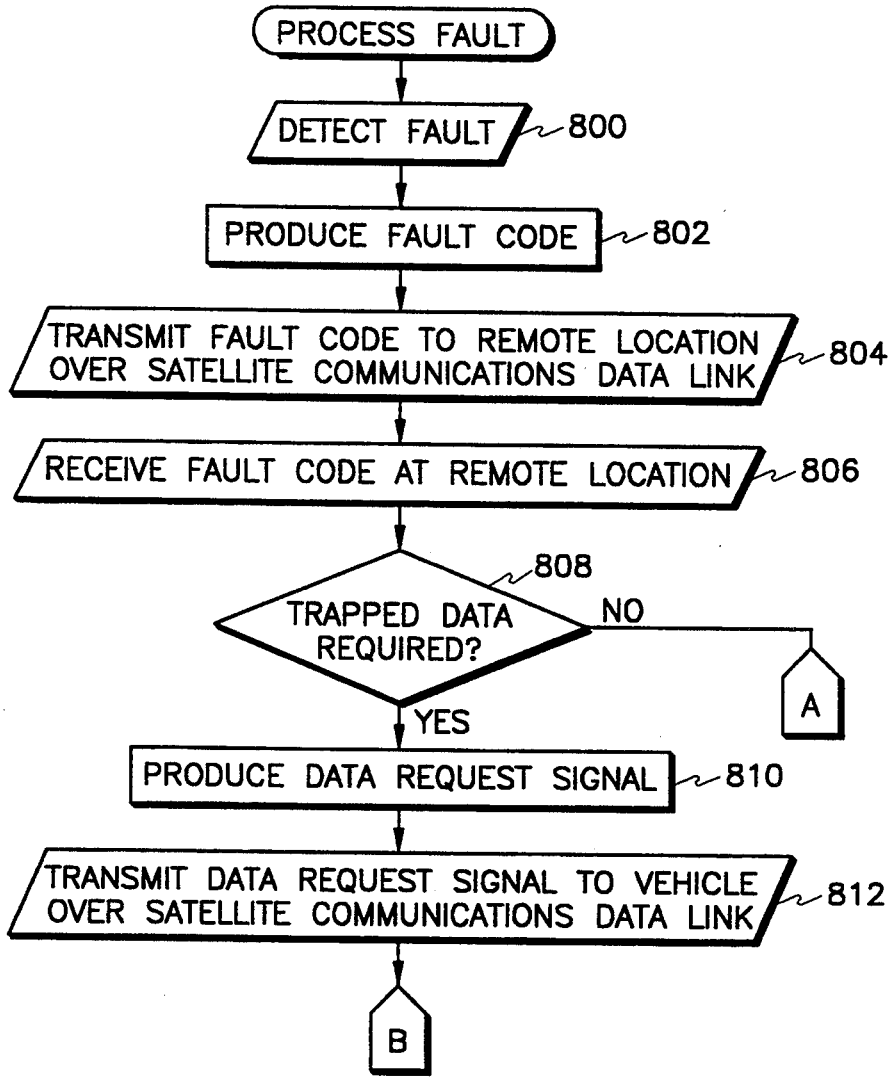
FIG. 8 is a first portion of a flow diagram illustrating the method of FIG. 7.
Figure 9:
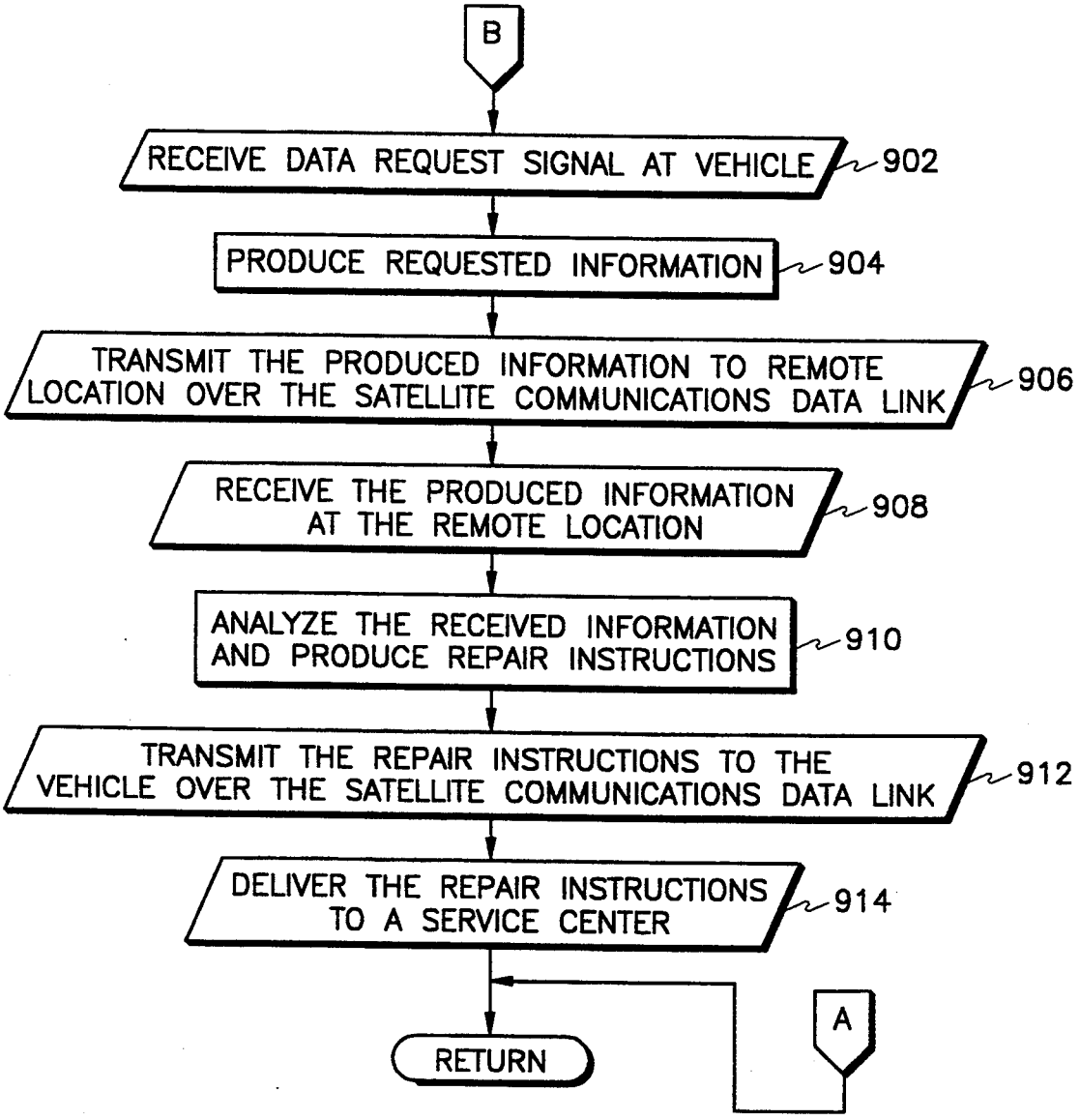
FIG. 9 is a second portion of a flow diagram illustrating the method of FIG. 7.

With reference to FIGS. 8 and 9, the present invention is embodied in a method for reducing the amount of data being relayed from a vehicle 104 to a remote location 116,118,218,220,222.

In a first control block 800 a fault is detected. The fault may be generated by the diagnostics, the prognostics, or it may be an operator initiated fault. In a second control block 802, a fault code is produced. The fault code gives an indication of the conditions of the fault. In a third control block 804, the fault code is transmitted over the satellite communications link 212 to a remote location. The fault code is received at the remote location in a fourth control block 806. An expert at the remote location analyzes the .fault code in view of the history of the vehicle and determines if data stored on the vehicle is needed (decision block 808).

If data stored on the vehicle is needed a data request signal is produced (fifth control block 810). The data request signal is indicative of the type and form of the requested data. In a sixth control block 812, the data request signal is transmitted to the vehicle over the satellite communications network 212.

Referring to FIG. 9, in a seventh control block 902, the data request signal is received by the monitor 210 at the vehicle through the transceiver 214. The monitor 210 retrieves the requested data from the storage device (tenth control block 904). In an eleventh control block 906 the requested data is transmitted back to the remote location over the satellite communications network 212. The data is received by the expert, analyzed, and a set of repair instructions are produced (twelfth and thirteenth control blocks). The repair instructions are then also sent to a service center (fourteenth control block 914).

The location of the service center will determine the communication medium used. For example, if the service center is located at the work site, the repair instructions may be sent over the satellite communications network 212. Other possible means of communications include radio frequency transceivers for short range communications and communications between computers via modems.

INDUSTRIAL APPLICABILITY

With reference to the drawings and in operation, the present invention provides a method for relaying information between a vehicle and a remote location. The information is used to perform diagnostics and prognostics, to generate repair instructions, and in the development of future diagnostics and prognostics.

The monitor 210 generates a plurality of fault codes in response to predetermined conditions from a number of sources. The sources include diagnostics and prognostics. Additionally, fault codes are generated in response to operator triggered signals.

The fault codes are indicative of the conditions which initiated the code, for example, a parameter exceeding its preset range. The fault code is transmitted to a remote location for analysis by an expert. The expert has access to the history of the particular vehicle. By analyzing the fault code in light of this record, the expert may (1) request information stored on the vehicle or (2) issue repair orders.

If the expert requests additional information a signal is generated and transmitted back to the vehicle. The monitor at the vehicle, retrieves the requested data from storage and places it in the proper form. Then, the gathered information is transmitted to the expert. The expert will then issue repair orders, based on the vehicle's history, the fault code, and the transmitted data.

Other aspects, objects, and features of the present invention can be obtained from a study of the drawings, the disclosure, and the appended claims.

We claim:

1. A method for reducing the amount of information relating to the status of a vehicle being relayed from the vehicle to a remote location over a communications data link, including the steps of:

generating a fault code;

delivering said fault code to the remote location across the data link;

receiving said fault code at the remote location and responsively analyzing said fault code in view of the vehicle history;

generating a data request signal if warranted by said fault code and said vehicle history;

delivering said data request signal to the vehicle over the data link;

receiving said data request signal and responsively generating vehicle information; and delivering said generated vehicle information to the remote location over the data link.

2. A method, as set forth in claim 1, including the steps of:

receiving said vehicle information;

analyzing said vehicle information and responsively generating repair instructions; and delivering said repair instructions to the vehicle over the data link.

3. A method, as set forth in claim 2, including the step of delivering said repair instructions to a service center.

4. A method, as set forth in claim 1, wherein the step of generating a fault code includes the steps of:

detecting the triggering of a driver fault button, and responsibly determining said fault code.

5. A method, as set forth in claim 1, wherein the step of generating a fault code includes the steps of:

detecting a prognostic fault, and responsibly producing said fault code.

6. A method, as set forth in claim 1, wherein the step of generating a fault code includes the steps of:

detecting a diagnostic fault, and responsibly producing said fault code.

7. A method, as set forth in claim 1, wherein the step of generating a fault code includes the steps of:

detecting one of a triggering of a driver fault button, a prognostic fault, and a diagnostic fault, and responsibly producing said fault code.

8. A method for reducing the amount of information relating to the status of a vehicle being relayed from the vehicle to a remote location, including the steps of:

generating a fault code;

delivering said fault code at the remote location across a satellite communications data link;

receiving said fault code at the remote location and responsively analyzing said fault code in view of the vehicle history;

generating a data request signal if warranted by said fault code and said vehicle history;

delivering said data request signal to the vehicle over the satellite communications data link;

receiving said data request signal and responsively generating vehicle information;

delivering said generated vehicle information to the remote location over the satellite communications data link;

receiving said vehicle information at the remote location;

analyzing said vehicle information and responsively generating repair instructions; and delivering said repair instructions to the vehicle over the satellite communications data link.

9. A method, as set forth in claim 8, including the step of delivering said repair instructions to a service center.

10. A method, as set forth in claim 8, wherein the step of generating a fault code includes the steps of:

detecting one of a triggering of a driver fault button, a prognostic fault, and a diagnostic fault, and responsively determining said fault code.

* * * * *